US010115506B2

(12) United States Patent
Hu et al.

(10) Patent No.: US 10,115,506 B2
(45) Date of Patent: Oct. 30, 2018

(54) ND—FE—B SINTERED MAGNET AND METHODS FOR MANUFACTURING THE SAME

(71) Applicants: BEIJING ZHONG KE SAN HUAN HI-TECH CO., LTD., Beijing (CN); SANVAC (BEIJING) MAGNETICS CO., LTD., Beijing (CN)

(72) Inventors: Boping Hu, Beijing (CN); Yugang Zhao, Beijing (CN); Jin Zhang, Beijing (CN); Guoan Chen, Beijing (CN); Xiaolei Rao, Beijing (CN); E Niu, Beijing (CN); Zhian Chen, Beijing (CN); Guoshun Jin, Beijing (CN); Jingdong Jia, Beijing (CN)

(73) Assignees: Beijing Zhong Ke San Huan Hi-Tech Co., LTD., Haidian District, Beijing (CN); Sanvac (Beijing) Magnetics Co., LTD., Chang Ping District, Beijing (CN)

( * ) Notice: Subject to any disclaimer, the term of this patent is extended or adjusted under 35 U.S.C. 154(b) by 329 days.

(21) Appl. No.: 14/655,014

(22) PCT Filed: Dec. 24, 2013

(86) PCT No.: PCT/CN2013/090319
§ 371 (c)(1),
(2) Date: Jun. 23, 2015

(87) PCT Pub. No.: WO2014/101747
PCT Pub. Date: Jul. 3, 2014

(65) Prior Publication Data

US 2015/0348685 A1 Dec. 3, 2015

(30) Foreign Application Priority Data

Dec. 24, 2012 (CN) ..... 2012 1 0566731

(51) Int. Cl.
*H01F 1/057* (2006.01)
*H01F 1/053* (2006.01)
(Continued)

(52) U.S. Cl.
CPC ..... *H01F 1/0577* (2013.01); *C22C 33/02* (2013.01); *C22C 38/002* (2013.01);
(Continued)

(58) Field of Classification Search
None
See application file for complete search history.

(56) References Cited

U.S. PATENT DOCUMENTS 5,472,525 A * 12/1995 Tokunaga ..... H01F 1/057 148/302
8,012,269 B2 9/2011 Yamamoto et al.
(Continued)

FOREIGN PATENT DOCUMENTS

CN 101266856 A * 9/2008
CN 101266856 A 9/2008
(Continued)

OTHER PUBLICATIONS

Espacenet machine translation of CN101266856; generated Mar. 1, 2018 (Year: 2018).*
(Continued)

*Primary Examiner* — Christopher S Kessler
*Assistant Examiner* — Rajinder Bajwa
(74) *Attorney, Agent, or Firm* — Finnegan, Henderson, Farabow, Garrett, & Dunner, LLP

(57) ABSTRACT

A sintered neodymium-iron-boron magnet, the main components thereof comprising rare-earth elements R, additional elements T, iron Fe and boron B, and having a rare-earth-enriched phase and a main phase of a Nd2Fe14B crystal structure. The sum of the numerical values of the maximum
(Continued)

Figure 1:
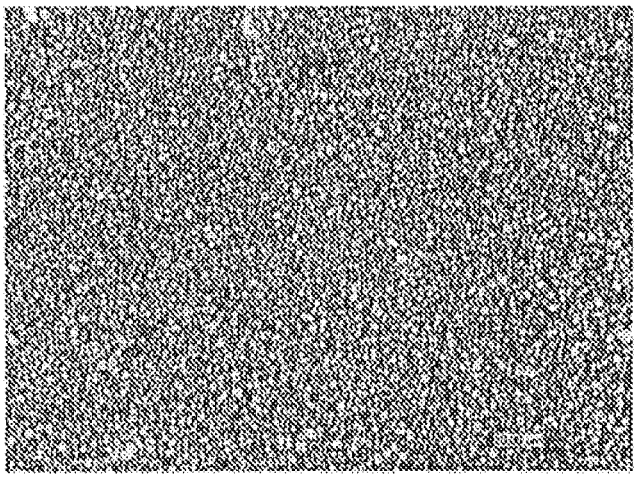

magnetic energy product (BH)max in units of MGOe and the intrinsic coercive force Hcj in units of kOe is not less than 70. The manufacturing method of the sintered neodymium-iron-boron magnet comprises alloy smelting, powder making, powder mixing, press forming, sintering and heat treatment procedures. By controlling the component formulation and optimizing the process conditions, the sintered neodymium-iron-boron magnet is enabled to simultaneously have a high maximum magnetic energy product and a high intrinsic coercive force.

16 Claims, 1 Drawing Sheet

(51) Int. Cl.

| | |
|---|---|
| ***H01F 7/02*** | (2006.01) |
| ***C22C 33/02*** | (2006.01) |
| ***H01F 41/02*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |

(52) U.S. Cl.

CPC ..... *C22C 38/005* (2013.01); *C22C 38/06* (2013.01); *C22C 38/10* (2013.01); *C22C 38/16* (2013.01); *H01F 1/0536* (2013.01); *H01F 7/02* (2013.01); *H01F 41/0266* (2013.01); *B22F 2998/00* (2013.01); *C22C 2202/00* (2013.01)

(56) References Cited

U.S. PATENT DOCUMENTS

| | | | | |
|---|---|---|---|---|
| 8,182,618 | B2 * | 5/2012 | Nozawa | B22D 11/0611 148/101 |
| 2006/0201585 | A1 | 9/2006 | Tomizawa et al. | |

FOREIGN PATENT DOCUMENTS

| | | | |
|---|---|---|---|
| CN | 101630557 | A | 1/2010 |
| CN | 101826386 | A | 9/2010 |
| CN | 102103917 | | 6/2011 |
| CN | 102592775 | A | 7/2012 |
| RU | 2113742 | C1 | 6/1998 |

OTHER PUBLICATIONS

Supplementary European Search Report for European Application No. 13869640.6, dated Jul. 26, 2016, from the European Patent Office.

"Operating Temperature of Permanent Magnets," Published on http://magnetmagazin.ru on Oct. 28, 2011 (2 pages).

* cited by examiner

ND—FE—B SINTERED MAGNET AND METHODS FOR MANUFACTURING THE SAME

This application is a national stage filing under 35 U.S.C. § 371 of International Application No. PCT/CN2013/090319, filed on Dec. 24, 2013, which claims priorty of Chinese Patent Application No. 201210566731.3 filed Dec. 24, 2012.

1. FIELD OF THE INVENTION

The present invention relates to a Nd—Fe—B sintered magnet and a method for manufacturing the same, particularly to a Nd—Fe—B sintered magnet with ultra-high performance and a method for manufacturing the same.

2. BACKGROUND OF THE INVENTION

Nd—Fe—B sintered magnets have been widely used in various fields such as electronics and information technology, automobiles, medical equipment, energy, and transportation, etc. Meanwhile, with the continuing improvement of technology and reduction of cost, Nd—Fe—B permanent magnets find wide potential applications in many emerging fields. With the advent of low-carbon economics, countries have paid attention to environmental protection and low carbon emissions as key science and technology fields. Therefore energy structure improvement, renewable energy development, increased energy efficiency, reduced energy consumption and carbon emission are in demand. New market emerges in low carbon industries such as wind-power generators, new-energy vehicles, energy-saving home appliances, etc. The new applications require improved performance of Nd—Fe—B sintered magnets. For example, the most popular laptop computers are equipped with 2.5-inch hard disks. The voice coil motors (VCM) of hard disks require N50H-grade Nd—Fe—B sintered magnets with the maximum energy product $(BH)_{max}$>48 MGOe and intrinsic coercivity $H_{cj}$>16 kOe. In another example, the thin plate high performance Nd—Fe—B magnets in ignition coil of automobile engines operate at a required working temperature higher than 200° C. the application requires N35EHS-grade sintered Nd—Fe—B magnets with $(BH)_{max}$>33 MGOe and coercivity $H_{cj}$>35 kOe. Both high $(BH)_{max}$ and high $H_{cj}$ are demanded of Nd—Fe—B magnets in emerging applications such as robotic walkers, integrated special motors, and automatic driving systems, etc. Rare earths are important strategic resources. Enhanced comprehensive magnetic properties of Nd—Fe—B sintered magnet improve efficient use of these resources. Therefore, the trend of developing Nd—Fe—B sintered magnets is to improve both $(BH)_{max}$ and $H_{cj}$ simultaneously.

Currently the major global manufacturers have launched high performance Nd—Fe—B sintered magnet products to meet specific purpose requirements. Hitachi Metals Co. has developed Nd—Fe—B sintered magnets with (BH)max of 53 MGOe for stable production; Vacuumschmelze (VAC) in Germany has put magnets of 50 MGOe (BH)max into mass production, and TDK Co. in Japan has also put commercial magnets with 48~50 MGOe (BH)max into mass production. However, none of the products achieves both high (BH)max and high Hcj. The typical magnetic properties of some of the commercialized high performance magnets are listed in Table 1.

TABLE 1

Magnetic properties of Nd—Fe—B sintered magnets with high performance produced by some global manufacturers

| Grade | Company | $B_r$/kGs | $H_{cj}$/kOe | $(BH)_{max}$/MGOe |
|---|---|---|---|---|
| NMX-S54 | Hitachi Metals Co. | 14.5~15.1 | 11 | 51~55 |
| NMX-S41EH | Hitachi Metals Co. | 12.4~13.1 | 25 | 37~42 |
| NMX-S34GH | Hitachi Metals Co. | 11.2~12 | 33 | 30~35 |
| VACODYM688TP | VAC | 11.4 | 36 | 32 |
| VACODYM745HR | VAC | 14.4 | 15 | 47 |

Table 1 shows that Nd—Fe—B sintered magnets with high $(BH)_{max}$ correlate to low $H_{cj}$. Similarly, the high $H_{cj}$ correlate to relatively low $(BH)_{max}$. In addition, the numeric sum of $(BH)_{max}$ and $H_{cj}$ of all products fall between 60 and 70.

The fundamental function of permanent magnets is to provide magnetic fields in application spaces. The maximum energy product $(BH)_{max}$ (MGOe) represents the capacity of a permanent magnet to provide magnetic energy output. With the same size, a permanent magnet of larger $(BI)_{max}$ provides stronger magnetic field. The intrinsic coercivity $H_{cj}$ (kOe) represents the capability of a magnet to keep itself stable in magnetized state. If $H_{cj}$ of a magnet is not high enough, $H_{cj}$ decays when the magnet is disturbed by demagnetizing field, temperature, or vibration, whereby the capacity of part or the whole of the magnet to provide magnetic field decreases, i.e., the capability of the magnet to maintain its magnetized state and to supply the magnetic field eventually decreases.

For Nd—Fe—B sintered magnets, the relationship between $H_{cj}$ and $(BH)_{max}$ or Remanence $B_r$ tends to be antagonistic. The magnet with high $H_{cj}$ has decreased $(BH)_{max}$ or $B_r$. $H_{cj}$ decreases if $(BH)_{max}$ or $B_r$ is enhanced. It follows that unconditional increase of the $H_{cj}$ would significantly affect $(BH)_{max}$ and decrease parameters and comprehensive characteristics of the magnet, and limit the applicability of the magnet. Therefore, in the field of Nd—Fe—B sintered magnets, the sum of $(BH)_{max}$ and $H_{cj}$ is considered to be a comprehensive parameter for the performance of a magnet.

3. SUMMARY OF THE INVENTION

High performance magnets should have high Curie temperature Tc, high remanence Br or Mr (Br=4 πMr) high intrinsic coercivity Hcj, and high maximum energy product (BH)max. The last three parameters Br, Hcj and (BH)max are referred to as the extrinsic magnetic properties of the permanent magnet. Curie temperature $T_c$, saturation magnetization $M_s$, and magnetocrystalline anisotropy $H_A$ are referred to as the intrinsic magnetic properties of the permanent magnet main phase. The extrinsic magnetic properties of permanent magnet are determined by the intrinsic magnetic properties of the permanent magnet main phase. Considering the multiphase microstructure of Nd—Fe—B sintered magnet and tiny volume ratio of minor phases, these three parameters can reasonably refer to the main phase of Nd2Fe14B-type tetragonal crystalline structure. Only the materials with excellent intrinsic magnetic properties are possible to be processed into high performance permanent magnets. For a permanent magnet, the higher Curie Temperature is, thes higher operating temperature range and better thermal stability.

The theoretical limit of maximum energy product $(BH)_{max}$ is determined by the saturation magnetization $M_s$, according to the relationship $(BH)_{max} \leq (4\pi Mr)^2/4 \leq (4\pi M_s)^2/4$.

Therefore only materials with high $M_s$ can be processed into permanent magnets with high $(B)_{max}$. Intrinsic coercivity is determined by $H_{cj}=CH_a—N(4\pi M_s)$, therefore materials with high $H_a$ can produce permanent magnets with high $H_{cj}$. But high $T_c$, high $M_s$ and high $H_a$ are not necessary to produce high performance permanent magnets, it also depends on. appropriate manufacture processes to achieve both high $H_{cj}$ and high $(BH)_{max}$. because the parameters C and N in above formula are sensitive to microstructure which is determined by manufacture process. The theoretical maximum saturation magnetization Ms of a permanent magnet is determined once the components of the permanent magnet are determined. If the magnet is composed of a single main phase, the theoretical maximum (BH)max may be achieved. Taking Nd—Fe—B magnet for example, if the magnet is composed of the single Nd2Fe14B crystalline phase (space group P42/mnm, tetragonal symmetry), and all grains are perfectly oriented along their easy magnetization direction (c-axis of the tetragonal phase), the theoretical $(BH)_{max}$ of approximate 64 MGOe can be achieved. However, this magnet has no intrinsic coercivity $H_{cj}$, and it is not a permanent magnet and cannot be used as a permanent magnet. The reasons why $H_{cj} \approx 0$ are as follows: the grains in matrix are in close contact with each other Magnetization of each grain distributes along both easy magnetization directions of c-axis with equal possibility. The total magnetization of both easy magnetization directions cancels out and the magnet does not show magnetic characteristics. When a magnetic field is applied along the c-axis, the magnetization of each crystallite will be parallel to the field. But when the magnetic field is removed, the magnetization of each grain redistributes equally along either direction of c-axis, and the total magnetization of the magnet returns to zero and shows no remanence or coercivity. The magnet has no permanent magnetic characteristics Therefore, in order to achieve certain level of intrinsic coercivity $H_{cj}$, it is necessary to introduce rare-earth rich phase along the boundary of main phase grains via powder metallurgy processes of rare-earth permanent magnet. Each of the magnet main phase grains has a magnetization direction along the magnetic field when it is under saturation magnetization charged along the orientation. When the magnetization field disappears, intrinsic coercivity prevents each grain from flipping its direction of magnetization but keeps each grain along the magnetization direction, and thus the magnet demonstrates extrinsic magnetic properties such as remanence and coercivity. This type of microstructure will effectively keep the magnetization of saturatedly magnetized grains along the magnetic field direction. The ratio of the main phase to the rare-earth rich phase should be moderate. In the case where the rare-earth rich phase content is too low, although the main phase content fraction is high, and saturation magnetization Ms of the magnet is high, increasing the upper level of the remanence and maximum energy product, the coercivity of the magnet may be too small. On the other hand, if the rare-earth rich phase is excessive, it will be beneficial to increase coercivity $H_{cj}$ but can decrease the percentage of $Nd_2Fe_{14}B$ crystalline structure main phase in the magnet, whereby decreasing $M_s$ and leading to decreased $B_r$ and $(BH)_{max}$.

In order to obtain Nd—Fe—B permanent magnet with relatively balanced remanence and intrinsic coercivity, maximizing the sum of $H_{cj}$ and $(BH)_{max}$, the present inventors have researched in the following two aspects in the present invention:

1. optimizing the composition ingredients of the magnet to ensure the main phase is of $Nd_2Fe_{14}B$ crystalline structure and the main phase is of appropriate fraction in the magnet. to obtain excellent intrinsic magnetic properties; and 2. optimizing the manufacturing process to exhibit the excellent intrinsic magnetic properties in the extrinsic magnetic properties.

Meanwhile, in present invention, additive element Co partially substitutes Fe, increasing the saturation magnetization $M_s$ and the Curie temperature $T_c$ of the main phase that is of $Nd_2Fe_{14}B$ crystalline structure and improving the temperature coefficient of remanence and the temperature coefficient of coercivity.

The present invention achieves the goals in the following ways:

A Nd—Fe—B sintered magnet comprising essentially of rare earth element R, additive element T, iron Fe, and boron B and having $Nd_2Fe_{14}B$-crystalline structure main phase and a rare-earth rich phase. It is characterized that the sum of the value of $H_{cj}$ (in unit of kOe) and $(BH)_{max}$ (in unit of MGOe) is no less than 70, i.e., $H_{cj}(kOe)+(BH)_{max}(MGOe) \geq 70$.

A Nd—Fe—B sintered magnet comprising essentially of rare earth element R, additive element T, iron Fe, and boron B and having $Nd_2Fe_{14}B$-crystalline structure main phase and a rare-earth rich phase. It is characterized that the area ratio of the main phase to the total area of the cross section of the magnet ranges from 91% to 97%, wherein the cross section of the magnet is perpendicular to the orientation direction (i.e. the normal direction of the surface is the orientation direction).

A Nd—Fe—B sintered magnet with a composition of rare earth element R, additive element T, iron Fe, and boron B, having $Nd_2Fe_{14}B$-crystalline structure main phase and a rare-earth rich phase. It is characterized that the Curie temperature $T_c$ of the magnet ranges from 310° C. to 340° C.

A method for manufacturing Nd—Fe—B sintered magnet, characterized by the production process comprising alloy melting, alloy crushing, powder mixing, pressing, block sintering, and post-sinter treating with heat.

In summary, the present invention improves remanence by optimizing the composition ingredients and the manufacture process to ensure appropriate fraction of the main phase and the orientation degree of the main phase crystal grains; the present invention enhances intrinsic coercivity $H_{cj}$ by optimizing the phase fraction and microstructure of rare-earth rich phase along the grain boundary. In this way, high performance Nd—Fe—B sintered magnet was achieved with both high maximum energy product and high intrinsic coercivity, wherein $(BH)_{max}(MGOe)+H_{cj}(kOe) \geq 70$. In addition, the present invention improves the temperature coefficient of remanence $\alpha_{Br}$ and the temperature coefficient of coercivity $\alpha_{Hcj}$ by increasing Curie temperature $T_c$, enhancing intrinsic coercivity $H_{cj}$, and optimizing the microstructure of the Nd—Fe—B sintered magnet, enabling application of the magnet in a wider temperature range.

4. DESCRIPTION OF THE DRAWINGS

FIG. 1 Metallographic photo of the cross section for magnetizing or with the normal direction being the magnetic orientation direction before black-and-white binarization treatment.

Figure 2:
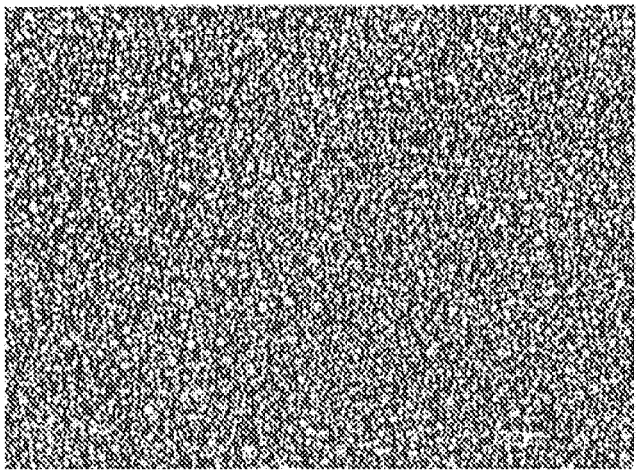

FIG. 2 Metallographic image of the cross section for magnetizing or with the normal direction being the magnetic orientation direction after black-and-white binarization treatment.

5. DESCRIPTION OF EMBODIMENTS

The theoretical limit of $(BH)_{max}$ of $Nd_2Fe_{14}B$ intermetallic compound, where 100% of the intermetallic compound is $Nd_2Fe_{14}B$ main phase, is approximately 64 MGOe. But in practice, the $(BH)_{max}$ of Nd—Fe—B sintered magnet is smaller. Because rare-earth rich phase exists around grain boundary of $Nd_2Fe_{14}B$ phase, resulting in intrinsic coercivity $H_{cj}$, and during the process, defects such as pores, impurities, and misaligned main phase grains etc. can lead it away from the ideal condition, decreasing the fraction of the main phase in the magnet, thus, remanence $B_r$ is decreased and consequently $(BH)_{max}$ is decreased.

It has been proven that the remanence $B_r$ of Nd—Fe—B sintered magnets can be determined by the following equation:

$$Br=4\pi Mr=4\pi Ms(\rho/\rho 0)(1-\alpha)f$$

wherein $M_s$ denotes the saturation magnetization of the main phase, $\rho/\rho_0$ denotes the relative density ($\rho$: magnet density; $\rho_0$: density of the main phase), $\alpha$ denotes the volume fraction of nonmagnetic phases, and f denotes grain alignment factor. In order to achieve high $(BH)_{max}$ of a permanent magnet, the fraction of the main phase of the sintered magnet should be increased, so that the alloy composition of the magnet can be as close to the composition of $Nd_2Fe_{14}B$ as possible (keeping high value of Ms), and in the meantime, appropriate content of rare-earth rich phase exists (smaller value of $\alpha$) for high density magnet ($\rho/\rho_0\approx 1$) via liquid phase sintering and uniformly distributed rare-earth rich phase around main phase grains so that high coercivity can be obtained for the magnet after sintering.

The intrinsic coercivity $H_{cj}$ of Nd—Fe—B sintered magnet can be determined by the following equation:

$$H_{cj}=CH_a-N(4\pi M_s)$$

wherein: $H_a$ denotes the magnetocrystalline anisotropy field of the main phase, C depends on grain-grain interaction and grain-boundary interaction, N denotes the effective demagnetizing factor. C and N sensitively depend on grain size, grain-size distribution and the orientation characteristics and boundary feature between adjacent grains. In order to obtain a magnet with high intrinsic coercivity $H_{cj}$, the magnetocrystalline anisotropy field $H_a$ of the main phase Nd2Fe14B crystalline structure of the magnet should be high enough, and further the factor C should be increased and N decreased by the optimizing process.

In the present invention, Nd—Fe—B sintered magnets with high comprehensive indexes with both $(BH)_{max}$ and $H_{cj}$ were obtained by optimizing the composition ingredients and the manufacture process. For example, the main phase of the magnet is an intermetallic compounds with $Nd_2Fe_{14}B$ crystalline structure and its lattice constants a=0.8760 nm~0.8800 nm and c=1.2000 nm~1.2230 nm. Further, for example, the maximum energy product $(BH)_{max}$ in MGOe and intrinsic coercivity $H_{cj}$ in kOe is no less than 70, i.e., $(BH)_{max}(MGOe)+H_{cj}(kOe)\geq 70$.

According to the intrinsic magnetic characteristics of $R_2Fe_{14}B$ intermetallic compounds, $Pr_2Fe_{14}B$ has high $M_s$ but low $H_a$. (For $Pr_2Fe_{14}B$, $4\pi M_s$=15.6 kGs, $H_a$=87 kOe. For $Nd_2Fe_{14}B$, $4\pi M_s$=16.0 kGs, $H_a$=76 kOe.) Comparatively, $Tb_2Fe_{14}B$ has higher $H_a$ but low $M_s$. (For $Tb_2Fe_{14}B$, $4\pi M_s$=7.0 kGs, $H_a$=220 kOe. For $Dy_2Fe_{14}B$, $4\pi M_s$=7.1 kGs, $H_a$=150 kOe.) Therefore, adjusting the combination of Pr, Nd, Tb, and Dy in different compositions can result in higher 4πMs (4πMr) (and consequently high $(BH)_{max}$, as well as higher $H_a$ (and consequently higher $H_{cj}$).

For example, in accordance with the present invention, a Nd—Fe—B sintered magnet has the magnetic properties of 80 kOe≤$H_a$≤140 kOe, $(BH)_{max}\geq 26$ MGOe, $B_r=4\pi Mr\geq 10.3$ kGs, and $H_{cj}\geq 18$ kGs, and $(BH)_{max}(MGOe)+H_{cj}(kOe)\geq 70$.

In another example, in accordance with the present invention, additive element Co partially substituted Fe, increasing the saturation magnetization $M_s$ and the Curie temperature $T_c$ of the $Nd_2Fe_{14}B$ crystalline main phase and improving the temperature coefficient of remanence $\alpha_{Br}$ and the temperature coefficient of coercivity $\alpha_{Hcj}$. One of the Nd—Fe—B sintered magnets in accordance with the present invention has the $T_c$ ranging from 310° C. to 340° C.

In a further example, in accordance with the present invention, the fraction of the main phase can be varied by adjusting the total content of the rare-earth element R (28 wt %~32 wt %). In the cross section of the magnet that is perpendicular to the orientation direction (i.e., the normal direction of the surface is the orientation direction), the ratio of the area of the main phase to the total area of the cross section ranges from 91% to 97%, particularly from 94% to 96%.

In the present invention, the optimized process for manufacturing high performance Nd—Fe—B sintered magnet comprises alloy melting, alloy crushing, powder mixing, pressing, block sintering, and post-sinter treating with heat. For example, a manufacture process comprises:

a. Alloy Melting

Strip casting technique is applied to produce alloy slates with thickness ranging from 0.1 to 0.5 mm. The oxygen content of the alloy slate ranges from 40 ppm to 160 ppm.

b. Alloy Crushing to Make Powders

Hydrogen decrepitation (HD) technique is applied to crush the alloy flakes into coarse powder. The hydrogen content of the coarse powder ranges from 500 ppm to 1600 ppm. The coarse powder is subsequently jet milled to fine powder of mean particle size ranging from 2.0 to 4.0 μm with an inert gas or $N_2$ jet. Almost all of the fine particles are monocrystalline.

c. Powder Mixing

The fine powder that is jet-milled at different times is uniformly mixed under an oxygen-free protective atmosphere. 200 to 500 ppm of lubricant as compared to the total weight of the mixed fine power are added during mixing to increase the fluidity of the fine powder and increase the degree of orientation during powder pressing.

d. Pressing

The evenly mixed fine powder is pressed into precursor block within an air-tight chamber filled with protective gas. An aligning magnetic field of 10 kOe~30 kOe is applied simultaneously for orientation. The resulting precursor blocks are kept in a container with gas protection.

e. Block Sintering:

The resulting precursor blocks are sintered at a temperature ranging from 1045° C. to 1085° C. in a vacuum sintering furnace in vacuum or under a protective atmosphere for a period of time ranging from 4 to 8 hours, and then Ar gas is filled into the furnace to cool the temperature inside of the furnace down to be lower than 100° C.

f. Post-Sinter Treating with Heat

Post-sinter heat treatment is in a vacuum furnace under vacuum or a protective atmosphere with two temperings: first, tempering at a temperature ranging from 850° C. to 950° C. under vacuum or a protective atmosphere for a period of time ranging from 3 to 5 hours. Then Ar gas is filled into the furnace to cool the temperature inside of the furnace down to be lower than 100° C.; then, tempering at a temperature ranging from 450° C. to 650° C. under vacuum or a protective atmosphere for a period of time ranging from 3 to 5 hours. Then Ar gas is filled into the furnace to cool the temperature inside of the furnace down to be lower than 80° C.

The resulting Nd—Fe—B sintered magnet has one or more of the characteristic parameters listed below, after the process above:

a. The average crystalline grain size of the main phase ranges from 5.0 μm to 10.0 μm. The rare-earth rich phase is relatively uniformly distributed along the grain boundary to achieve high $H_{cj}$. Smaller grain size would make the manufacture process more difficult, and larger grain size would make it more difficult to obtain high $H_{cj}$.

b. The degree of orientation of the grain of Nd—Fe—B sintered magnet main phase is high and the misalignment factor of the magnet $B_r^{\perp}/B_r$ is less than 0.15, wherein $B_r^{\perp}$ denotes the remanence perpendicular to the orientation direction; and $B_r$ denotes the remanence parallel to the orientation direction. The smaller the value of $B_r^{\perp}/B_r$ is, the better the degree of orientation of the grain of the magnet's main phase.

c. The oxygen content of the Nd—Fe—B sintered magnet ranges from 500 ppm to 2500 ppm. Although the process above is in vacuum or protective gases such as $N_2$, inert gas or the mixture of them, the fine powder inevitably absorbs $O_2$, forming rare-earth oxides (detectable by X-ray refraction). The formation of rare-earth oxides would decrease the $H_{cj}$ of magnets and waste rare-earth metals.

d. The hydrogen content of the Nd—Fe—B sintered magnet is not more than 10 ppm. Excessive hydrogen content would lead to adversary effects, such as cracks in the magnet.

e. The density of the Nd—Fe—B sintered magnets is high, ranging from 7.60 g/cm$^3$ to 7.80 g/cm$^3$.

f. The Nd—Fe—B sintered magnet has optimized microstructure and thus excellent corrosion resistance. The absolute value of weight loss for Ø10 mm×10 mm cylindrical specimen is no more than 5 mg/cm$^3$ after being exposed to the environment of 130° C., 95% relative humidity, and 2.6 atmospheric pressure (atm) for 240 hours.

g. The temperature coefficient of remanence within the temperature range of 20° C.~180° C. is $\alpha_{Br}$=−0.122%/° C.~−0.090%/° C. With the smaller absolute value of $\alpha_{Br}$, the remanence decreases at a slower pace with increasing temperature.

h. The temperature coefficient of intrinsic coercivity within the temperature range of 20° C.~180° C. is βHcj=−0.50%/° C.~−0.20%/° C. With the smaller absolute value of □Hcj, the intrinsic coercivity decreases at a slower pace with increasing temperature.

i. The absolute value of the irreversible open-circuit flux loss of the Ø10 mm×8 mm cylindrical specimen (the permeance coefficient $P_c$=−B/H=2) is no more than 5% after exposure at a temperature within the range of 20° C.~200° C. for 120 minutes. The axial direction of the cylindrical specimen is the orientation direction. In general, the temperature corresponding to the absolute value of the irreversible open-circuit flux loss≤5% is considered to evaluate the thermal stability of the magnet: the, this temperature is quoted as maximum working temperature. higher such corresponding temperature is, the better the thermal stability of the magnet.

The embodiments of the present invention are further described below.

In the present invention, the method of manufacturing a Nd—Fe—B sintered magnet is optimized. The process comprises alloy melting, alloy crushing, powder mixing, pressing, block sintering, and post-sinter treating with heat. For example, The alloy melting uses strip casting technique. The thickness of the resulting alloy slates ranges from 0.1 to 0.5 mm. The oxygen content of the alloy slates ranges from 40 ppm to 160 ppm.

The alloy crushing makes the resulting alloy slates from the vacuum strip casting furnace into coarse powder by hydrogen decrepitation (HD) process. The hydrogen content of the powder after the hydrogen decrepitation process ranges from 500 to 1600 ppm. The coarse powder is further jet milled into fine powder of mean particle size ranging from 2.0 to 4.0 μm with nitrogen gas, inert gas or mixture of nitrogen and inert gas.

In order to homogenize particle size and composition distribution, the fine powder in different time periods of jet milling is sufficiently mixed. And 0.02-0.05 wt % of lubricant compared with the total weight of the mixed fine powder is added to the fine powder to increase the fluidity and the degree of orientation in pressing process. The lubricant can be organic compounds such as poloyol, or poly propylene glycol. The fine powder is mixed in a container filled with protection gas of nitrogen, inert gas or mixture of nitrogen and inert gas, wherein the capacity of container ranges from 50 to 2000 kg and the container is kept moving three-dimensionally for a period of time ranging from 1 to 5 hours.

Subsequently, the mixed fine powder is pressed in an enclosed press under the protection of nitrogen, inert gas or mixture of nitrogen and inert gas. An orientation magnetic field is applied in pressing at a field magnitude ranging from 10 to 30 kOe. The C-axil of the monocrystal grain of the fine powder with good lubricity consistently lines along the orientation direction of the magnetic field. And the fine power is pressed into precursor blocks. Then the precursor blocks are stored in a container filled with protection gas of nitrogen, inert gas or mixture of nitrogen and inert gas.

The pressed precursor blocks are sent into a vacuum sintering furnace and sintered at a temperature ranging from 1045 to 1085° C. for a period of time ranging from 4 to 8 hours in vacuum or under the protective gas, then Ar gas is filled in the furnace to cool the temperature inside of the furnace to be below 100° C.

The precursor blocks after sintering magnets are tempered twice in vacuum or under protective gas: First, tempering at a temperature ranging from 850 to 950° C. for a period of time ranging from 3 to 5 hours, and then filling Ar gas into the furnace to cool the temperature inside of the furnace to be below 100° C.; Second, tempering at a temperature ranging from 450 to 650° C. for a period of time ranging from 3 to 5 hours and filling Ar gas into the furnace to cool the temperature inside of the furnace to be below 80° C.

The protective gas during the sintering and tempering processes can be nitrogen, inert gas or mixture of nitrogen and inert gas.

A Nd—Fe—B sintered magnet according to the present invention consists essentially of rare-earth element R, additive element T, iron Fe and boron B, having a main phase of Nd2Fe14B crystalline structure and a rare-earth rich phase. Rare earth element R is one or more elements selected from Y, Sc, and fifteen elements of lanthanide series. Additive element T is one or more elements selected from Ti, V, Cr, Mn, Co, Ni, Cu, Zn, Ga, Ge, Al, Zr, Nb, Mo, and Sn. For example, R is one or more elements selected from Nd, Pr, Dy, Tb, and Ho, and T is one or more elements selected from Al, Cu, Co, Ga, Ti, V, Zr, Nb, Mo, and Sn.

For example, a Nd—Fe—B sintered magnet according to the present invention can have a composition of 18~26 wt % Nd+Pr, 2~13.5 wt % Dy+Tb, 0~0.6 wt % Al, 0~0.2 wt % Cu, 0~3 wt % Co, 0~0.2 wt % Ga, 0.93~1.0 wt % B with iron Fe and impurity being the balance.

Cylinders of dimensions Ø10.0 mm×10.0 mm are wire cut from sintered magnet blocks with the height direction as the orientation direction. After saturate magnetization along the orientation direction, the demagnetization curves of cylinders are measured by hysteresis loop tracer to obtain permanent magnet parameters. At the temperature of 20° C., a sintered magnet according to the present invention has remanence Br≥10.3 kGs, intrinsic coercivity Hcj≥18 kOe, maximum energy product $(BH)_{max}$≥26 MGOe. In particular, the numeric sum of Hcj (in kOe) and (BH)max (in MGOe)≥70. For example, the numeric sum of Hcj (in kOe) and (BH)max (in MGOe)≥70, ≥71, ≥72, ≥73, ≥74, ≥75, ≥76, ≥77, ≥78, ≥79, or ≥80. Moreover, the numeric sum of Hcj (kOe) and (BH)max (MGOe) is in the range of 70~93, 70~90, 70~85, 75~93, 75~90, or 75~85.

According to the present invention, the maximum energy product (BH)max (MGOe) of a sintered Nd—Fe—B magnet can be ≥26, ≥28, ≥30, ≥32, ≥34, ≥36, ≥38, ≥40, ≥42, or ≥44. The intrinsic coercivity Hcj (kOe) of a sintered Nd—Fe—B magnet can be ≥18, ≥20, ≥22, ≥24, ≥26, ≥28, ≥30, ≥32, ≥32, ≥34, ≥36, ≥38, ≥40, ≥42, ≥44, ≥46, ≥48, or ≥50. The remanence Br (kGs) of a sintered magnet can be ≥10.3, ≥10.7, ≥11.1, ≥11.5, ≥11.8, ≥12.2, ≥12.5, ≥12.8, ≥13.2, or ≥13.5.

For example, according to the present invention, a Nd—Fe—B based sintered magnet consists essentially of rare-earth element R, additive element T, iron Fe and boron B, having a main phase of Nd2Fe14B crystalline structure and a rare-earth rich phase. The magnet is characterized that the main phase area percentage of the entire cross-section area ranges from 91% to 97% on the cross section perpendicular to the alignment direction (The normal direction of the cross section is the orientation direction). For example, this main phase area percentage is in a range of 92%~96%, or 92%~95%, or 93%~96%.

Cylinders of dimensions Ø10.0 mm×10.0 mm are wire cut from sintered magnet blocks with the height direction perpendicular to the orientation direction. After saturate magnetization perpendicular to the orientation direction, the demagnetization curves of the cylinders are measured by hysteresis loop tracer perpendicular to the orientation direction. In this way, the remanence perpendicular to the orientation direction $B_r^{\perp}$ is obtained. Comparing $B_r^{\perp}$ to the remanence parallel to the orientation direction $B_r$, the degree of orientation of the grains of the magnet's main phase can be evaluated. According to the present invention, a sintered magnet demonstrates $B_r^{\perp}/B_r<0.15$ at the temperature of 20° C. For example, $B_r^{\perp}/B_r<0.12$, <0.10, or <0.08.

A sintered magnet can be analyzed by X-ray diffraction (XRD) to confirm that the main phase of the Nd—Fe—B sintered magnet has $Nd_2Fe_{14}B$ crystalline structure. At the temperature of 20° C., the lattice parameters of a sintered magnet of the present invention are a=0.8760~0.8800 nm and c=1.2000~1.2230 nm.

The density of a cylinderic sintered magnet with dimensions of Ø10.0 mm×10.0 mm is measured by drainage method. The density of a sintered magnet according to the present invention ranges from 7.60 to 7.80 g/cm$^3$ at the temperature of 20° C.

The microstructure of the sintered magnet can be observed with a metalographical microscope and analyzed metallographically. The observed cross section is the cross section where the the normal direction of the surface is the magnetizing (orientation) direction, i.e., perpendicular to the magnetizing (orientation) direction. The average grain size of the main phase is measured in accordance with metallography in Chinese National Standard GB/T 6394-2002. Average grain size of the main phase is measured by using unimodal distribution of line length. In this way, the average grain size of the main phase in a sintered magnet of the present invention ranges from 5.0 to 10.0 μm.

The percentage of the main phase of the sintered Nd—Fe—B magnet on a cross section can be determined by metallographical microscopy observation and by a method of quantitative metallography analysis system (QMA). The observation cross section of the sample is the cross section where the normal direction is the sintered magnet's magnetizing (orientation) direction. By selecting a field of view under a certain magnification, the area of the whole selected field (AT) and the area of the main phase (A) within this field are measured respectively. Then the area percentage of the main phase to be tested $A_a$ is calculated as A/AT. The professional software Image-Pro Plus (IPP) of MediaCybernetics can be used to analyze the result of the observation. Based on this method, the percentage of the main phase in the Nd—Fe—B sintered magnet of the present invention is 91%-97% compared to the total area of the cross section perpendicular to the orientation direction of the magnet (the normal direction of the surface is the orientation direction). In particular, the percentage ranges from 94 to 96% compared to the total area of the cross section.

The oxygen and hydrogen contents are analyzed by an Eltra ONH2000 analyzer. The oxygen content of a sintered Nd—Fe—B magnet according to the present invention ranges from 500 to 2500 ppm. And the hydrogen content is ≤10 ppm. The oxygen content refers to all of oxygen existing in a sintered magnet, including oxygen in compounds and elementary substance. Similarly, the hydrogen content refers to all of hydrogen existing in a sintered magnet including oxygen in both compounds and elementary substance.

A vibrating sample magnetometer (VSM) is used to measure the temperature dependence of magnetization (M) in an applied magnetic field of less than 400 Oe to determine the Curie temperature Tc of the magnet's main phase. The M-T data are collected on a magnet of about 50 mg. The results show that the Curie temperature of the main phase in a sintered Nd—Fe—B magnet of the present invention ranges from 310 to 340° C.

A sample cube of the sintered magnet of 1.5 mm edge length is applied with an external magnetic field of maximum strength 130 kOe, The magnetization curves are measured by a superconducting quantum interference device (SQUID) VSM with magnetic fields applied parallel and perpendicular to the orientation direction respectively. The measured data are corrected by an open circuit demagnetization factor. Then the crystalline anisotropy field $H_a$ is estimated from the cross point of the two M-H curves or the cross point of the extension lines of the M-H curves along the directions parallel and perpendicular to the alignment direction. The results show that the anisotropy field $H_a$ of the main phase in a sintered Nd—Fe—B magnet of the present invention ranges from 80 to 140 kOe at the temperature of 20° C.

The temperature coefficients of remanence ($\alpha_{Br}$) and coercivity ($\beta_{Hcj}$) are measured as follows: Samples of sintered magnet are cut into cylinders of 10.0 mm in diameter× 10.0 mm in height, which is the orientation direction. At a selected temperature, the cylinders are saturately magnetized, and then the demagnetization curve along the orientation along the orientation direction is measured. The demagnetization curve at temperature $T_o$=20° C. is measured first to obtain the remanence $B_r(T_0)$ and coercivity $H_{cj}(T_0)$. Then, the the demagnetization curve at temperature T=180° C. is measured to obtain remanence $B_r(T)$ and coercivity $H_{cj}(T)$. Then the temperature coefficients of remanence ($\alpha_{Br}$) and coercivity ($\beta_{Hcj}$) can be calculated by the following equations:

$$\alpha_{B_r} = -\frac{B_r(T_0) - B_r(T)}{B_r(T_0) \times (T - T_0)} \times 100\%$$

$$\beta_{H_{cj}} = -\frac{H_{cj}(T_0) - H_{cj}(T)}{H_{cj}(T_0) \times (T - T_0)} \times 100\%$$

According to equations above, within the temperature range of 20° C. and 180° C., the temperature coefficient of remanence ($\alpha_{Br}$) in a sintered Nd—Fe—B magnet of the present invention ranges from −0.125%/° C. to −0.090%/° C. And the temperature coefficient of coercivity ($\beta_{Hcj}$) in a sintered Nd—Fe—B magnet of the present invention ranges from −0.50%/° C. to −0.20%/° C.

The method for measuring the irreversible loss: The sintered Nd—Fe—B magnet is cut into cylinders of dimensions Ø10.0 mm×8.8 mm. The axial direction of the cylinders is the orientation direction. These cylinders have permeance coefficients $P_c$=−B/H of 2 (wherein B=H+4 πM, H is the applied magnetic field, M is the magnetization). The permeance coefficient of an independent magnet can be calculated by the equation $$P_c = \frac{L_M}{A_M}\sqrt{\pi \times s},$$

wherein $L_M$ is the height of the orientation direction, $A_M$ is the cross-section area of the cross section where the normal direction is the magnetizing direction, and S is ½ of the surface area of cylinder magnet. After magnetization, the magnetic flux of the magnet at temperature of 20° C. ($\Phi_{20}$) is measured by Helmholtz coil and fluxmeter. Then the magnet is kept at temperature of 200° C. for 120 minutes with the temperature's control precision of ±1° C. And then the temperature is cooled to room temperature. Again the magnetic flux is measured by Helmholtz coil and fluxmeter, as $\Phi_T$. The irreversible flux loss from temperature of 20° C. to temperature of 200° C. is $(\Phi_{200}-\Phi_{20})/\Phi_{20}\times100\%$. Under the above conditions, the absolute value of irreversible flux loss of a sintered Nd—Fe—B magnet in a temperature range of 20° C.-200° C. according to the present invention is less than or equal to 5%.

The weight loss of a sintered Nd—Fe—B magnet WL(mg/cm$^2$) is defined as $(W_1-W_0)/S_0$ wherein $W_0$ is the weight of the sample before the test, and $W_1$ is the weight of the sample after the test, and $S_0$ is the surface area of the sample before the test. The detailed testing conditions include: cylinder samples of 10.0 mm in diameter×10.0 mm in height, which is the orientation direction is exposed to 130° C., 95% relative humidity, and 2.6 atm for 240 hours. The weight loss WL of a sintered Nd—Fe—B magnets in the present invention is less than or equal to 5 mg/cm$^2$.

EXAMPLE 1

Appropriate amounts of the raw material, alloys of Pr—Nd, Dy—Fe, and Tb—Fe, and metal Nd, Pr, Al, or Cu, and F were used in accordance with the composition of the magnet of the target: Nd (18.00 wt %), Pr (7.00 wt %), Dy (1.40 wt %), Tb (4.00 wt %), Co (1.40 wt %), Al (0.10 wt %), Cu (0.13 wt %), Ga (0.20 wt %), B (0.95 wt %), and Fe as balance (including trace amount of impurities) (66.82 wt %) (consider a certain amount of rare earth evaporates). The resulting materials were melted and cast into slates by a strip casting (SC) process. The SC alloy slates were 0.1~0.5 mm in thickness. The strips were loaded into an oxygen-treatment furnace and decreptated into coarse powder by hydrogen decreptation (HD) process. The hydrogen content of the coarse powder after HD was 600 ppm. Then the coarse powder was crushed into fine powders with mean particle size of 2.8 μm with a jet mill. Nitrogen was used as crushing gas. In order to make particle size and composition distribution homogenously, the fine powder of during different periods of time of jet milling was mixed sufficiently. An amount of 350 ppm of polyol lubricant compared to the total weight of the mixed fine power was added to increase the mobility and improve the degree of the orientation during pressing. The fine powder was mixed in a container with capacity of 50 kg. The container moved three-dimensionally under the protection of nitrogen gas for one hour.

Subsequently, the resulting fine powder was pressed in an enclosed press under the protection of nitrogen gas. A magnetic field of 18 kOe was applied in magnetization direction. Then the resulting precursor blocks were stored in a container under the protection of nitrogen gas.

The precursor blocks were taken out of the storage container and sintered in a vacuum sintering furnace for 5 hours at 1045° C., and Ar gas was filled to cool the temperature inside of the furnace to be below 80° C. to obtain the sintered precursor block magnet.

The sintered precursor block magnets were tempered at 900° C. for 3 hours and Ar gas was filled to cool the temperature inside of the furnace to be below 80° C., and then the temperature was raised to 620° C. and kept for 3 hours and Ar gas was filled to cool the temperature inside of the furnace to be below 80° C.

The sintered magnet had a composition of Nd (18.00 wt %), Pr (7.00 wt %/), Dy (1.40 wt %), Tb (4.00 wt %), Co (1.40 wt %), Al (0.10 wt %), Cu (0.13 wt %), Ga (0.20 wt %), and B (0.95 wt %), and Fe (including trace amount of impurities) (66.82 wt %).

The XRD result showed that the main phase of the sintered Nd—Fe—B magnet had $Nd_2Fe_{14}B$ crystalline structure. At the temperature of 20° C., the lattice parameters of the sintered magnet were a=0.8791 nm, c=1.2178 nm.

The density of the cylinder sample with dimensions of 10.0 mm in diameter×10.0 mm in height was measured by drainage method. The density of the sintered magnet in present invention was 7.66 g/cm$^3$.

A vibrating sample magnetometer (VSM) was used to measure the temperature dependence of magnetization (M) in an applied magnetic field of 300 Oe to determine the Curie temperature Tc of the sintered Nd—Fe—B magnet. The M-T data were collected on a magnet sample of 50 mg. The results showed that the Curie temperature of the main phase of the sintered Nd—Fe—B magnet of the present invention was 332° C.

A sintered Nd—Fe—B magnet sample was cut into cube of 1.5 mm edge length. The magnetization curves were measured by a superconducting quantum interference device (SQUID) VSM with an external magnetic field of 0-70 kOe applied parallel and perpendicular to the orientation direction respectively. The measured data were corrected by the open circuit demagnetization factor. Then the crystalline anisotropy field $H_a$ was estimated from the cross point of extension lines of the M-H curves along the directions parallel and perpendicular to the orientation direction. The results showed that the anisotropy field $H_a$ of the main phase of the sintered magnet of the present invention was 110 kOe at the temperature of 20° C.

The oxygen and hydrogen contents were analyzed by Eltra ONH2000 analyzer. The oxygen content of the sintered Nd—Fe—B magnet according to the present invention was 1000 ppm. And the hydrogen content was 5 ppm.

A cylindrical sample of 10 mm in diameter×10 mm in height, which was the orientation direction, was measured for demagnetization curves after saturate magnetization along the orientation direction, the demagnetization curve is measured by hysteresis loop tracer along the orientation direction at the temperature of 20° C. The results were $B_r$=13.0 kGs, $H_{cj}$=31.6 KOe, $(BH)_{max}$=40.9 MGOe and $(BH)_{max}$(MGOe)+$H_{cj}$(kOe)=72.5.

A cylindrical sample of 10 mm in diameter×10 mm in height, which was perpendicular to the orientation direction, was measured for demagnetization curve after saturate magnetization perpendicular to the orientation direction by hysteresis loop tracer along the direction perpendicular to the orientation direction at the temperature of 20° C. to obtain remanence perpendicular to the orientation direction $B_r^{\perp}$=0.80 kGs. This $B_r^{\perp}$ is divided by $B_r$=13.0 kGs obtained above to give a result of $B_r^{\perp}/B_r$ as 0.06 in the sintered magnet of the present invention.

The microstructure of the sintered magnet was observed with a metalographical microscope and analyzed metallographically. The observed cross section was perpendicular to the orientation direction (the normal direction is the orientation direction). The average grain size of the main phase was measured in accordance with metallography Chinese National Standard GB/T 6394-2002. Average grain size of the main phase in a sintered Nd—Fe—B magnet of the present invention, as measured by using unimodal distribution of line length, was 5.0 m.

The area percentage of the main phase of the sintered Nd—Fe—B magnet on a cross section perpendicular to the orientation direction (the normal direction is the orientation direction) was determined by a metallographical microscopy observation and by a method of quantitative metallography analysis system (QMA) together with the professional software Image-Pro Plus (IPP) of MediaCybernetics. By selecting three different fields of view under the magnification of 500×, the area of the whole selected field (AT) of 0.6 mm×0.5 mm and the area of the main phase (A) within these fields of view were measured respectively, and then the average value was used as the final observation result.

FIG. 1 shows the metallograpic image of the cross section of the magnet sample before black-and-white binarization treatment. FIG. 2 shows the metallographic image of the cross section of the magnet sample after black-and-white binarization treatment. The observation results of the three fields of view show that the area percentages of the main phase were 94.6%, 94.9% and 94.6%, respectively. The average value of the three results shows that the area percentage of the main phase in this example was 94.7%.

A cylindrical sample of 10 mm in diameter×10 mm in height, which was the orientation direction was measured for demagnetization curve after saturate magnetization along the orientation direction. At $T_0$=20° C., $B_r(T_0)$=13.0 kGs and $H_{cj}(T_0)$=31.6 kOe were obtained. At T=180° C., $B_r(T)$=10.4 kGs and $H_{cj}(T)$=9.55 kOe were obtained. Therefore, within the temperature range of 20° C.-180° C., temperature coefficient of remanence ($\alpha_{Br}$) in the sintered magnet of the present invention was −0.125%/° C. The corresponding temperature coefficient of coercivity ($\beta_{Hcj}$) was −0.436%/° C.

A cylindrical sample of 10 mm in diameter×8.8 mm in height, which was the orientation direction, was taken whose permeance coefficient Pc=−B/H=2. After magnetization of the sample, the magnetic flux of the magnet at room temperature of 20° C. ($\Phi_{20}$) was measured by Helmholtz coil and fluxmeter. Then the magnet sample was kept at 200° C.±1° C. for 120 minutes and cooled to room temperature. Again the magnetic flux was measured by Helmholtz coil and fluxmeter ($\Phi_{200}$.) The irreversible flux loss is $(\Phi_{200}-\Phi_{20})/\Phi_{20}$. In the present example, the irreversible flux lost at 200° C. was −2.1%.

A cylindrical sample of 10 mm in diameter×10 mm in height was placed at 130° C., 95% relative humidity, and 2.6 atm for 240 hours, the weight loss of the sintered magnet in the present example was −3.3 mg/cm$^2$.

EXAMPLES 2-17

Examples 2-17 used the same manufacture method and process route as those in Example 1, but differed from each other only in compositions of the magnets and process parameters. Therefore specific description is not mentioned here. The measurement of all kinds of performance was based on the same method and instrument as those in Example 1. The detailed process parameters of each example and the performance parameters of the resulting magnets are summarized in Table 2.

TABLE 2

Summary of process and performance parameters in Examples 1~17

| Composition (wt %) | Example 1 | Example 2 | Example 3 | Example 4 | Example 5 | Example 6 |
|---|---|---|---|---|---|---|
| Nd | 18.00 | 20.00 | 24.00 | 15.50 | 19.00 | 18.80 |
| Pr | 7.00 | 5.00 | 0.00 | 4.00 | 3.00 | 5.00 |
| Dy | 1.40 | 0.00 | 0.50 | 6.50 | 5.00 | 0.00 |
| Tb | 4.00 | 5.50 | 5.50 | 3.50 | 4.50 | 6.00 |
| Al | 0.10 | 0.20 | 0.18 | 0.20 | 0.40 | 0.60 |
| Cu | 0.13 | 0.12 | 0.16 | 0.12 | 0.14 | 0.20 |
| Co | 1.40 | 0.50 | 2.00 | 0.50 | 1.00 | 3.00 |
| Ga | 0.20 | 0.20 | 0.14 | 0.12 | 0.14 | 0.20 |
| B | 0.95 | 0.97 | 0.96 | 0.98 | 1.00 | 1.00 |

TABLE 2-continued

Summary of process and performance parameters in Examples 1~17

| | | | | | | |
|---|---|---|---|---|---|---|
| Fe | 66.82 | 67.51 | 66.56 | 68.58 | 65.82 | 65.20 |
| Thickness Range of SC Alloy (mm) | 0.1-0.5 | 0.1-0.5 | 0.1-0.5 | 0.1-0.5 | 0.1-0.5 | 0.1-0.5 |
| The Oxygen Content of SC alloy (ppm) | 40 | 72 | 125 | 160 | 106 | 93 |
| The Hydrogen Content of Coarse Powder after HD (ppm) | 500 | 856 | 1024 | 1290 | 1600 | 1462 |
| The Mean Particle Size of Fine Powder (μm) | 2.5 | 3.0 | 3.4 | 4.0 | 3.2 | 3.8 |
| The Proportion of Liquid Lubricant (ppm) | 400 | 350 | 380 | 300 | 280 | 390 |
| Sintering Temperature (° C.) | 1045 | 1055 | 1075 | 1085 | 1067 | 1070 |
| Sintering Time (h) | 8.0 | 4.0 | 4.0 | 5.0 | 4.5 | 4.0 |
| First Tempering Temperature (° C.) | 850 | 915 | 930 | 940 | 920 | 950 |
| First Tempering Time (h) | 3.0 | 4.0 | 3.0 | 5.0 | 4.5 | 3.5 |
| Second Tempering Temperature (° C.) | 620 | 450 | 490 | 650 | 480 | 485 |
| Second Tempering Time (h) | 5.0 | 4.0 | 3.0 | 4.0 | 4.5 | 5.0 |
| The Oxygen Content of Sintered Magnet (ppm) | 1000 | 1250 | 2500 | 1500 | 2013 | 1300 |
| The Hydrogen Content of Sintered Magnet (ppm) | 5.0 | 3.2 | 4.1 | 1.4 | 2.6 | 0.3 |
| Br (kGs) | 13.0 | 12.6 | 12.8 | 11.9 | 11.6 | 12.9 |
| Hcj (kOe) | 40.9 | 37.9 | 35.5 | 42.6 | 45.4 | 39.5 |
| (BH)max (MGOe) | 31.6 | 38.8 | 39.5 | 34.2 | 32.5 | 40.2 |
| (BH)max (MGOe) + Hcj (kOe) | 72.5 | 76.7 | 75.0 | 76.8 | 77.9 | 79.7 |
| The Area Ratio of Main Phase Aa (%) | 94.7 | 93.9 | 94.9 | 97.0 | 92.8 | 95.0 |
| $Br^{\perp}$ (kGs) | 0.80 | 1.6 | 1.5 | 1.4 | 1.7 | 1.7 |
| $Br^{\perp}/Br$ | 0.06 | 0.13 | 0.12 | 0.12 | 0.15 | 0.13 |
| Average Grain Size (μm) | 5.0 | 6.6 | 8.2 | 10.0 | 7.2 | 9.1 |
| Lattice Parameter a (nm) | 0.8791 | 0.8783 | 0.8785 | 0.8788 | 0.8786 | 0.8778 |
| Lattice Parameter c (nm) | 1.2178 | 1.2130 | 1.2149 | 1.2161 | 1.2154 | 1.2120 |
| Density (g/cm3) | 7.66 | 7.67 | 7.71 | 7.75 | 7.74 | 7.67 |
| Curie temperature Tc (° C.) | 335 | 322 | 333 | 322 | 326 | 336 |
| Magnetocrystalline Anistropic Field Ha (kOe) | 110.0 | 113.9 | 104.1 | 101.1 | 105.5 | 115.4 |
| $\alpha_{Br}$ (%/° C.) (20~180° C.) | −0.125 | −0.108 | −0.094 | −0.108 | −0.103 | −0.090 |
| $\beta_{Hcj}$ (%/° C.) (20~180° C.) | −0.436 | −0.390 | −0.390 | −0.360 | −0.340 | −0.380 |
| Irreversible Flux Loss (@180° C.) (%) | −2.10 | −1.99 | −2.18 | −1.20 | −0.74 | −1.72 |
| Weight Loss (mg/cm$^2$) | −3.3 | −3.2 | −3.4 | −2.9 | −2.7 | −3.1 |

| Composition (wt %) | Example 7 | Example 8 | Example 9 | Example 10 | Example 11 | Example 12 |
|---|---|---|---|---|---|---|
| Nd | 25.00 | 18.70 | 13.00 | 14.60 | 13.30 | 21.00 |
| Pr | 0.00 | 5.00 | 6.00 | 5.00 | 5.20 | 4.00 |
| Dy | 0.00 | 2.00 | 10.00 | 9.10 | 13.50 | 1.50 |
| Tb | 4.50 | 4.80 | 1.00 | 1.80 | 0.00 | 3.50 |
| Al | 0.20 | 0.40 | 0.00 | 0.20 | 0.40 | 0.20 |
| Cu | 0.14 | 0.14 | 0.00 | 0.12 | 0.14 | 0.12 |
| Co | 2.00 | 3.00 | 0.00 | 0.50 | 1.00 | 0.50 |
| Ga | 0.14 | 0.14 | 0.00 | 0.20 | 0.14 | 0.12 |
| B | 0.96 | 1.00 | 0.93 | 0.97 | 1.00 | 0.98 |
| Fe | 67.06 | 64.82 | 69.07 | 67.51 | 65.32 | 68.08 |
| Thickness Range of SC Alloy (mm) | 0.1-0.5 | 0.1-0.5 | 0.1-0.5 | 0.1-0.5 | 0.1-0.5 | 0.1-0.5 |
| The Oxygen Content of SC alloy (ppm) | 125 | 93 | 60 | 72 | 106 | 150 |
| The Hydrogen Content of Coarse Powder after HD (ppm) | 1024 | 1462 | 600 | 856 | 1500 | 1290 |
| The Mean Particle Size of Fine Powder (μm) | 3.4 | 2.0 | 2.8 | 3.0 | 3.2 | 4.0 |
| The Proportion of Liquid Lubricant (ppm) | 390 | 320 | 250 | 250 | 200 | 360 |
| Sintering Temperature (° C.) | 1075 | 1070 | 1045 | 1055 | 1067 | 1085 |
| Sintering Time (h) | 4.0 | 4.0 | 8.0 | 4.0 | 4.5 | 5.0 |
| First Tempering Temperature (° C.) | 930 | 950 | 900 | 915 | 920 | 940 |
| First Tempering Time (h) | 3.0 | 3.5 | 3.0 | 4.0 | 4.5 | 5.0 |
| Second Tempering Temperature (° C.) | 490 | 485 | 620 | 470 | 480 | 450 |
| Second Tempering Time (h) | 3.0 | 5.0 | 5.0 | 4.0 | 4.5 | 4.0 |
| The Oxygen Content of Sintered Magnet (ppm) | 2500 | 1300 | 800 | 1250 | 2013 | 1500 |

TABLE 2-continued

| Summary of process and performance parameters in Examples 1~17 | | | | | | |
|---|---|---|---|---|---|---|
| The Hydrogen Content of Sintered Magnet (ppm) | 4.1 | 0.3 | 10.0 | 3.2 | 2.6 | 1.4 |
| Br (kGs) | 12.9 | 12.1 | 11.1 | 11.1 | 10.3 | 12.6 |
| Hcj (kOe) | 33.5 | 39.3 | 40.6 | 41.6 | 44.3 | 32.2 |
| (BH)max (MGOe) | 40.1 | 35.3 | 30.1 | 29.8 | 26 | 38.4 |
| (BH)max (MGOe) + Hcj (kOe) | 73.6 | 74.6 | 70.7 | 71.4 | 70.3 | 70.6 |
| The Area Ratio of Main Phase Aa (%) | 94.8 | 94.0 | 95.4 | 94.6 | 95.7 | 94.6 |
| $Br^{\perp}$ (kGs) | 1.6 | 1.3 | 1.2 | 1.1 | 1.1 | 1.5 |
| $Br^{\perp}/Br$ | 0.12 | 0.11 | 0.11 | 0.10 | 0.11 | 0.12 |
| Average Grain Size (μm) | 8.0 | 9.3 | 6.0 | 6.7 | 7.3 | 10.0 |
| Lattice Parameter a (nm) | 0.8785 | 0.8779 | 0.8790 | 0.8789 | 0.8791 | 0.8785 |
| Lattice Parameter c (nm) | 1.2151 | 1.2129 | 1.2174 | 1.2170 | 1.2187 | 1.2144 |
| Density (g/cm3) | 7.70 | 7.69 | 7.76 | 7.76 | 7.80 | 7.68 |
| Curie temperature Tc (° C.) | 333 | 339 | 324 | 322 | 326 | 322 |
| Magnetocrystalline Anistropic Field Ha (kOe) | 98.7 | 109.7 | 91.4 | 94.2 | 81.1 | 102.3 |
| $\alpha_{Br}$ (%/° C.) (20~180° C.) | −0.094 | −0.090 | −0.106 | −0.108 | −0.103 | −0.108 |
| $\beta_{Hcj}$ (%/° C.) (20~180° C.) | −0.430 | −0.380 | −0.380 | −0.370 | −0.350 | −0.440 |
| Irreversible Flux Loss (@180° C.) (%) | −2.73 | −1.76 | −1.54 | −1.37 | −0.92 | −2.95 |
| Weight Loss (mg/cm$^2$) | −3.6 | −3.1 | −3.0 | −2.9 | −2.8 | −3.8 |

| Composition (wt %) | Example 13 | Example 14 | Example 15 | Example 16 | Example 17 |
|---|---|---|---|---|---|
| Nd | 22.50 | 17.10 | 17.30 | 15.50 | 12.00 |
| Pr | 3.50 | 7.00 | 6.00 | 4.50 | 6.00 |
| Dy | 1.00 | 0.00 | 2.00 | 0.00 | 3.50 |
| Tb | 2.00 | 7.00 | 5.20 | 10.00 | 10.00 |
| Al | 0.10 | 0.10 | 0.10 | 0.10 | 0.10 |
| Cu | 0.08 | 0.08 | 0.12 | 0.08 | 0.14 |
| Co | 0.90 | 1.00 | 1.20 | 1.00 | 1.50 |
| Ga | 0.12 | 0.20 | 0.20 | 0.20 | 0.15 |
| B | 0.94 | 0.96 | 0.94 | 0.96 | 0.97 |
| Fe | 68.86 | 66.56 | 66.94 | 67.66 | 65.64 |
| Thickness Range of SC Alloy (mm) | 0.1-0.5 | 0.1-0.5 | 0.1-0.5 | 0.1-0.5 | 0.1-0.5 |
| The Oxygen Content of SC alloy (ppm) | 67 | 82 | 105 | 125 | 75 |
| The Hydrogen Content of Coarse Powder after HD (ppm) | 1125 | 1260 | 954 | 1460 | 960 |
| The Mean Particle Size of Fine Powder (μm) | 3.6 | 3.6 | 3.8 | 3.7 | 3.5 |
| The Proportion of Liquid Lubricant (ppm) | 500 | 340 | 300 | 300 | 230 |
| Sintering Temperature (° C.) | 1048 | 1065 | 1070 | 1072 | 1075 |
| Sintering Time (h) | 4.0 | 4.2 | 4.0 | 5.0 | 4.5 |
| First Tempering Temperature (° C.) | 925 | 950 | 920 | 915 | 930 |
| First Tempering Time (h) | 3.0 | 3.5 | 4.5 | 4.0 | 3.0 |
| Second Tempering Temperature (° C.) | 480 | 480 | 485 | 470 | 490 |
| Second Tempering Time (h) | 4.0 | 4.5 | 5.0 | 4.0 | 3.0 |
| The Oxygen Content of Sintered Magnet (ppm) | 500 | 1350 | 1625 | 840 | 1450 |
| The Hydrogen Content of Sintered Magnet (ppm) | 0.1 | 0.4 | 2.6 | 1.2 | 3.1 |
| Br (kGs) | 14.6 | 12.4 | 12.0 | 11.9 | 10.7 |
| Hcj (kOe) | 18.0 | 43.0 | 50.3 | 58.0 | 65.0 |
| (BH)max (MGOe) | 52 | 37.5 | 35.1 | 34.5 | 28 |
| (BH)max (MGOe) + Hcj (kOe) | 70 | 80.5 | 85.4 | 92.5 | 93 |
| The Area Ratio of Main Phase Aa(%) | 95.2 | 93.4 | 93.5 | 94.6 | 91 |
| $Br^{\perp}$ (kGs) | 2.0 | 1.5 | 1.5 | 1.5 | 1.3 |
| $Br^{\perp}/Br$ | 0.14 | 0.12 | 0.12 | 0.13 | 0.12 |
| Average Grain Size (μm) | 8.7 | 6.8 | 7.2 | 9.5 | 8.3 |
| Lattice Parameter a (nm) | 0.8782 | 0.878 | 0.8782 | 0.8781 | 0.8782 |
| Lattice Parameter c (nm) | 1.2130 | 1.2000 | 1.2131 | 1.2121 | 1.2127 |
| Density (g/cm3) | 7.60 | 7.67 | 7.69 | 7.72 | 7.75 |
| Curie temperature Tc (° C.) | 310 | 327 | 324 | 332 | 332 |
| Magnetocrystalline Anistropic Field Ha (kOe) | 100.4 | 124.1 | 113.6 | 133.1 | 139.8 |
| $\alpha_{Br}$ (%/° C.) (20~180° C.) | −0.120 | −0.102 | −0.106 | −0.095 | −0.095 |
| $\beta_{Hcj}$ (%/° C.) (20~180° C.) | −0.500 | −0.357 | −0.311 | −0.263 | −0.219 |

TABLE 2-continued

| Summary of process and performance parameters in Examples 1~17 | | | | | |
|---|---|---|---|---|---|
| Irreversible Flux Loss (@180° C.) (%) | −4.98 | −1.13 | 0.00 | 0.00 | 0.00 |
| Weight Loss (mg/cm$^2$) | −5.0 | −2.8 | −2.0 | −0.5 | −0.1 |

It should be noted that while the present invention disclosed above and embodiments are meant to prove the practical application of the technical solution that the present invention provides, they should not be used to limit the protection scope of the present invention. One of ordinary skilled in the art can modify, replace by equivalents, and improve in various ways within the spirit and theory of the present invention The protection scope of the present invention is defined by the following claims.

What is claimed is:

1. A sintered Nd-Fe-B magnet consisting essentially of: rare earth element R, additive element T, iron Fe, and boron B, wherein said magnet comprises a rare-earth rich phase and a main phase of $Nd_2Fe_{14}B$ crystalline structure, and wherein the numeric sum of maximum energy product $(BH)_{max}$ in MGOe and intrinsic coercivity $H_{cj}$ in kOe is no less than 76, i.e., $(BH)_{max}(MGOe)+H_{cj}(kOe)\geq 76$, wherein said magnet comprises 28 to 32 wt % rare earth element R, 0-4wt % additive element T, 0.93-1.0 wt % boron B, with the balance of iron Fe, and impurities, wherein R is one or more elements selected from Y, Sc, and fifteen elements of lanthanide series, wherein T is one or more elements selected from Ti, V, Cr, Mn, Co, Ni, Cu, Zn, Ga, Ge, Al, Zr, Nb, Mo, and Sn, wherein the average crystalline grain size of said main phase is in a range from 5.0 μm to 9.1 μm, and wherein oxygen content of said magnet is in a range from 1000 to 1625 ppm.

2. A sintered Nd—Fe—B magnet according to claim 1, wherein maximum energy product $(BH)_{max}$ is no less than 26 MGOe, wherein the intrinsic coercivity $H_{cj}$ is no less than 18 kOe, and wherein remanence $B_r$ is no less than 10.3 kGs.

3. A sintered Nd—Fe—B magnet according to claim 1, wherein the ratio of remanence perpendicular to the orientation direction Br(⊥) to the remanence parallel to the orientation direction $B_r$, $B_r(\perp)/B_r$ is less than 0.15.

4. A sintered Nd—Fe—B magnet according to claim 1, wherein the temperature coefficient of remanence $\alpha_{Br}$ within the temperature range of 20° C.-180° C. ranges from −0.125%/° C. to −0.090%/° C.

5. A sintered Nd—Fe—B magnet according to claim 1, wherein the temperature coefficient $\beta_{Hcj}$ of intrinsic coercivity $H_{cj}$ within the temperature range of 20° C.-180° C. ranges from −0.50%/° C to −0.20%/° C.

6. A sintered Nd—Fe—B magnet according to claim 1, wherein the absolute value of weight loss of a cylinder magnet of 10 mm in diameter and 10 mm in height is no more than 5 mg/cm$^2$ after being placed at 130° C., 95% relative humidity and 2.6 atm for 240 hours.

7. A sintered Nd—Fe—B magnet according to claim 1, wherein hydrogen content of said magnet is no more than 10 ppm.

8. A sintered Nd—Fe—B magnet according to claim 1, wherein the density of said magnet ranges from 7.60 to 7.80 g/cm$^3$.

9. A sintered Nd—Fe—B magnet according to claim 1, wherein R is one or more elements selected from Nd, Pr, Dy, Tb, and Ho, and T is one or more elements selected from Ti, V, Co, Cu, Ga, Al, Zr, Nb, Mo, and Sn.

10. A sintered Nd—Fe—B magnet according to claim 9, wherein R comprises 18-26 wt % Nd and Pr, 2.0-13.5 wt % Dy and Tb, and wherein T comprises 0.1-0.6 wt % Al, 0-0.2 wt % Cu, 0-3 wt % Co, 0-0.2 wt % Ga, 0.93-1.0 wt % B, and wherein Fe and impurities are the balance.

11. A sintered Nd—Fe—B magnet according to claim 1, wherein the area of said main phase ranges from 91 to 97% of the total area of the cross section perpendicular to the orientation direction of said magnet (the normal direction of the surface is the orientation direction).

12. A sintered Nd—Fe—B magnet according to claim 11, wherein the area of said main phase ranges from 94 to 96% of the total area of any cross section perpendicular to the orientation direction of said magnet (the normal direction of the surface is the orientation direction).

13. A sintered Nd—Fe—B magnet according to claim 11, wherein lattice constant a of said main phase $Nd_2Fe_{14}B$ crystalline structure ranges from 0.8760 to 0.8800 nm, and lattice constant c of said main phase $Nd_2Fe_{14}B$ crystalline structure ranges from 1.2000 to 1.2230 nm.

14. A sintered Nd—Fe—B magnet according to claim 11, wherein magnetocrystalline anisotropy fields $H_a$ of the magnetic main phase ranges from 80 to 140 kOe.

15. A sintered Nd—Fe—B magnet according to claim 1, wherein Curie temperature of said magnet ranges from 310 to 340° C.

16. A sintered Nd—Fe—B magnet according to claim 15, wherein absolute value of irreversible loss of magnetic flux along the height (orientation direction) of a cylindrical magnet of a permeance coefficient Pc=−B/H of 2, 10 mm in diameter, and 8.8 mm in height is no more than 5% after being placed at a temperature no higher than 200° C. for 120 minutes.

* * * * *